US010994279B2

(12) United States Patent
Schneider

(10) Patent No.: US 10,994,279 B2
(45) Date of Patent: May 4, 2021

(54) METHOD AND DEVICE FOR COMMINUTING KITCHEN WASTE AND/OR FOOD RESIDUES

(71) Applicant: MEIKO GREEN Waste Solutions AG, Bütschwil (CH)

(72) Inventor: Fritz Schneider, St. Gallen (CH)

(73) Assignee: MEIKO GREEN WASTE SOLUTIONS AG, Bütschwil (CH)

( * ) Notice: Subject to any disclaimer, the term of this patent is extended or adjusted under 35 U.S.C. 154(b) by 185 days.

(21) Appl. No.: 16/153,583

(22) Filed: Oct. 5, 2018

(65) Prior Publication Data

US 2019/0105660 A1 Apr. 11, 2019

(30) Foreign Application Priority Data

Oct. 5, 2017 (EP) ..... 17194956

(51) Int. Cl.

| | |
|---|---|
| ***B02C 18/00*** | (2006.01) |
| ***B02C 18/22*** | (2006.01) |
| ***E03C 1/266*** | (2006.01) |
| ***B02C 25/00*** | (2006.01) |
| ***B02C 18/12*** | (2006.01) |
| ***B02C 23/36*** | (2006.01) |
| ***B02C 23/38*** | (2006.01) |

(52) U.S. Cl.

CPC ..... *B02C 18/0092* (2013.01); *B02C 18/0084* (2013.01); *B02C 18/12* (2013.01); *B02C 18/2275* (2013.01); *B02C 18/2291* (2013.01); *B02C 23/36* (2013.01); *B02C 23/38* (2013.01); *B02C 25/00* (2013.01); *E03C 1/2665* (2013.01)

(58) Field of Classification Search

CPC ..... B02C 18/0092; B02C 18/0084; B02C 18/2291; B02C 18/2275; B02C 23/06; B02C 23/38

USPC ..... 241/46.013

See application file for complete search history.

(56) References Cited

U.S. PATENT DOCUMENTS

| | | | | |
|---|---|---|---|---|
| 8,789,776 | B2 * | 7/2014 | Lee | E03C 1/2665 241/30 |
| 9,782,779 | B2 * | 10/2017 | Kim | B02C 18/0092 |
| 10,399,088 | B2 * | 9/2019 | Chesack | B02C 23/18 |
| 2006/0283991 | A1 * | 12/2006 | Nishikawa | E03C 1/266 241/46.013 |
| 2007/0001039 | A1 * | 1/2007 | Steinbeck | B02C 18/0084 241/46.013 |

(Continued)

FOREIGN PATENT DOCUMENTS

| | | |
|---|---|---|
| EP | 2492405 | 8/2012 |

*Primary Examiner* — Faye Francis

(74) *Attorney, Agent, or Firm* — Haynes and Boone LLP

(57) ABSTRACT

A method for comminuting kitchen waste and/or food residues includes receiving kitchen waste and/or food residues in a funnel, a base of which is provided with a grinding unit for comminuting the kitchen waste and/or food residues and which is connected by the grinding unit via a product line to a pump for pumping away comminuted kitchen waste and/or food residues, and pumping away the kitchen waste and/or food residues comminuted by the grinding unit. Prior to the pumping-away step, precomminution of the kitchen waste and/or food residues located in the funnel is carried out in the funnel by means of a precomminution unit projecting into the funnel. A correspondingly designed device for implementing the method is also described.

20 Claims, 5 Drawing Sheets

(56) References Cited

U.S. PATENT DOCUMENTS

| | | | | |
|---|---|---|---|---|
| 2009/0272830 | A1* | 11/2009 | Wang | E03C 1/2665 241/46.013 |
| 2011/0147499 | A1* | 6/2011 | Ceru | E03C 1/2665 241/23 |
| 2013/0175374 | A1* | 7/2013 | Ham | B02C 23/22 241/46.013 |
| 2014/0306042 | A1* | 10/2014 | Chesack | B02C 18/0084 241/36 |
| 2014/0319252 | A1* | 10/2014 | McClory | B02C 18/0092 241/46.013 |
| 2016/0002902 | A1* | 1/2016 | Kim | B02C 23/10 241/19 |
| 2017/0197857 | A1* | 7/2017 | Whitener | B02C 25/00 |
| 2017/0203987 | A1* | 7/2017 | McMahon | B02C 25/00 |

* cited by examiner

METHOD AND DEVICE FOR COMMINUTING KITCHEN WASTE AND/OR FOOD RESIDUES

CROSS REFERENCE TO RELATED APPLICATIONS

This application claims priority from European Patent Application No. EP 17 194 956.3, filed on Oct. 5, 2017 in the European Patent and Trademark Office, the disclosure of which is incorporated herein by reference in its entirety.

BACKGROUND

Technical Field

The present invention relates to a device and to a method for comminuting kitchen waste and/or food residues, for example, for homogenizing kitchen waste and/or food residues.

Related Art

Organic kitchen waste, such as peeling and trimming waste, and food residues occur daily in large quantities, for example in commercial kitchens, canteens, hotels, community care facilities, in other types of catering and in supermarkets. Said organic kitchen waste and food residues can be used as the basic material for generating regenerative energy in biogas reactors and for producing fertilizers. For this purpose, the organic kitchen waste and food residues have to be treated in such a manner that they are capable of being stored and transported.

In order to dispose of and store the organic kitchen waste, systems are known in which the organic kitchen waste and food residues are placed into a disposal device in which they are comminuted by means of a comminution device in the form of a grinding unit, some with addition of water, in such a manner that they can be subsequently pumped away in a substantially homogenized form into corresponding storage tanks. From said storage tanks, the biomass which is then substantially homogenized is transported by means of a transport vehicle to a biogas plant in which the biomass is fermented, wherein the biogases arising during the fermentation, in particular methane gas, is used for generating electrical energy and/or thermal energy. Organic kitchen waste can thereby be recycled and energy which is renewable in an environmentally friendly manner can be obtained therefrom. In addition, the remaining, generally runny fermentation residue can be recycled in agriculture in the form of fertilizers or soil improvers.

EP 2492405 A1 discloses a device in which kitchen waste and food residues to be comminuted are placed into a funnel-shaped receptacle, at the base of which a grinding unit is arranged for comminuting the kitchen waste, and downstream of which a pump is mounted. During the operation of the device, consequently as the grinding unit rotates and the pump is simultaneously running, the kitchen waste and food residues are comminuted in the grinding unit and sucked up by means of the pump mounted downstream of the grinding unit. The suction of the pump causes a vacuum in the direction of the pump, and therefore a flow composed of comminuted kitchen waste and food residues is generated from the grinding unit in the direction of the pump. On account of pumping away the comminuted kitchen waste and food residues, further kitchen waste and food residues can enter the grinding unit, and therefore substantially all of the kitchen waste and food residues located in the receptacle can be successively comminuted and pumped away.

In order, during the comminution and pumping-away operation, to obtain improved feeding of the kitchen waste and food residues in the receptacle towards the grinding unit, a precomminution unit, which projects into the receptacle and is in the form of a driver provided with comminution blades is fastened to a rotor of the grinding unit and rotates synchronously with the rotor as the latter rotates. As a result, the food residues and kitchen waste are partially already precomminuted before they strike against the grinding unit. Due to the volumetric flow from the grinding unit in the direction of the pump, uncomminuted and sticky and fibrous materials pass into the grinding unit and on into the product line connecting the grinding unit and the pump, which may lead to agglomerations of the aforementioned materials and/or clogging in the grinding unit, the product line and/or the pump. In order to avoid this, a greater or lesser quantity of process water is always fed in during the operation of the device in order to prevent agglomerations.

SUMMARY

A method for comminuting kitchen waste and/or food residues, for example for homogenizing kitchen waste and/or food residues is described. The method includes the step of receiving kitchen waste and/or food residues in a funnel, a base of which is provided with a grinding unit for comminuting the kitchen waste and/or food residues and which is connected by the grinding unit via a product line to a pump for pumping away comminuted kitchen waste and/or food residues, being loaded with kitchen waste and/or food residues to be comminuted, and the step of the kitchen waste and/or food residues, comminuted by the grinding unit, being pumped away by means of the pump. Prior to the pumping-away step, precomminution of the kitchen waste and/or food residues located in the funnel is carried out in the funnel by means of a precomminution unit projecting into the funnel.

Owing to the fact that, prior to the pumping-away step, precomminution of the kitchen waste and/or food residues located in the funnel is carried out in the funnel by means of a precomminution unit projecting into the funnel, an improved comminution result can be obtained and the effort expended on maintaining a device which is operated according to the method can be reduced. The activated precomminution unit ensures that the kitchen waste and/or food residues are already cut up and/or broken up in the funnel. Since, during the precomminution, the precomminuted kitchen waste and/or food residues are not pumped away by the pump, which is switched off, the kitchen waste and/or food residues initially remain in the funnel and can be further comminuted there.

By means of the precomminution of the kitchen waste and/or food residues, the cell structures of said biowaste are already substantially smashed in the funnel in such a manner that the water contained in the kitchen waste and food residues is already released in the funnel. A multiplicity of kitchen waste and food residues contain a large amount of water which is rendered useable by the precomminution step before the kitchen waste and/or food residues are comminuted in the grinding unit. By making the water contained in the kitchen waste and food residues useable, the need for process water fed in externally is reduced, which in turn reduces the volume of the biomass to be disposed of and therefore lowers the disposal cost.

In addition, the kitchen waste and/or food residues located in the funnel are already homogenized in the funnel. Consequently, a homogenized mass, for example an aqueous suspension having a generally mushy consistency, which is composed of the precomminuted kitchen waste and/or food residues and the water released therefrom, is already formed in the funnel by means of the precomminution which takes place prior to the pumping-away operation and consequently the comminution by means of the grinding unit. The kitchen waste and/or food residues precomminuted in such a manner facilitate subsequent comminution by the grinding unit when they are sucked off from the funnel through the grinding unit on account of starting of the pumping action of the pump.

During the precomminution step, the kitchen waste and/or food residues are typically already comminuted in such a manner that a mass which is capable of being pumped off arises. In other words, the mass which has arisen by means of the precomminution of the kitchen waste and/or food residues is sufficiently aqueous and homogeneous that it substantially closely covers the funnel base at least in the region of the grinding unit is such a manner that a vacuum generated by the pump extends in the direction of the pump as far as into the funnel region in which the aqueous suspension is present, and consequently into the base region of the funnel. The precomminuted kitchen waste and/or food residues or the homogenized suspension thereof are already sucked up prior to the grinding unit and, by means of the flow which thus arises, sucked into the grinding unit; consequently, they can be particularly efficiently further comminuted therein. In addition, by means of the flow already beginning in the funnel, the occurrence of agglomerations in the grinding unit can be reduced or even entirely avoided. In particular, the distribution of the flow arising in the grinding unit is thereby more uniform.

The precomminution generally takes place for a definable period of time before the pump is started. Alternatively, the beginning of the pumping-away operation can also start by manual input or a control command.

In some embodiments, the precomminution unit generates a whirlpool circulating in the funnel during the precomminution, wherein the precomminution unit typically generates the circulating whirlpool in the funnel by means of a rotational movement about an axis of rotation of the precomminution unit. Consequently, the kitchen waste and/or food residues in the funnel additionally undergo stirring or mixing by means of the precomminution unit. This gives rise in the funnel to a whirlpool which generally circulates the material in the funnel in the horizontal and at the same time also in the vertical direction.

In the circulating whirlpool generated by the precomminution unit, the kitchen waste and/or food residues rotate at different speeds, depending on the position the funnel. The speed of the kitchen waste and/or food residues is higher the closer they are to the precomminution unit. At an increasing distance from the precomminution unit and decreasing distance from the funnel wall, the speed decreases, wherein the particles are slowed down in particular by rubbing on the funnel walls and against one another. The parts or mass flows moving at different speeds and also the rubbing against one another brings about a further comminution of the kitchen waste and/or food residues in the whirlpool, as a result of which an even more intensified precomminution or prehomogenization of the kitchen waste and/or food residues already takes place in the funnel. By means of the precomminution or prehomogenization, a relatively homogenous biomass consequently forms in the funnel, wherein the entire contents of the funnel are gradually moved through the whirlpool and comminuted.

In this method, the kitchen waste and food residues are typically so finely comminuted that the cell structures of the materials are destroyed, the water the materials contain is released and a homogeneous, free-flowing mass arises.

In several embodiments, prior to and/or during the precomminution, a predetermined quantity of process water is introduced into the funnel and/or into the product line, for example via a nozzle arranged in the funnel and/or in the product line, and/or a water inlet. The homogenization of the precomminuted kitchen waste and/or food residues can thereby be intensified. In addition, the water content of the mass arising from the kitchen waste and/or food residues by the precomminution can thus be increased or adapted in order to obtain a favourable consistency for the subsequent comminution in the grinding unit and pumping away by the pump.

In certain embodiments, a certain quantity of process water is typically introduced, at least into the product line, prior to the beginning of the precomminution. The quantity is generally dimensioned in such a manner that the product line is completely filled, wherein typically the process water poured in reaches as far as the upper region of the grinding unit. It is thereby firstly provided that the pump which is arranged at the end of the product line can directly pump fluid and does not have to first produce a negative pressure by displacing air. Secondly, agglomerations in the grinding unit and in the product line in the pump due to adhesion of powdery, sticky and/or fibrous materials can thereby be avoided. Alternatively, such a quantity of process water can also be introduced into the product line that the water level rises beyond the upper edge of the grinding unit rotor into the funnel. In particular in the case of powdery and/or dry materials, this method of supplying water has the advantage that the materials even in the lowermost zone of the funnel obtain sufficient process water for producing a mass having a mushy, pumpable consistency. In addition, solid residues which accumulate between the blade ring and the rotor of the grinding unit and thereby possibly block the starting of the processing cycle are washed out. In this case, process water is additionally introduced into the processing cycle and, although said process water somewhat increases the water portion of the mass, which is produced by the precomminution, on the basis of the precomminuted kitchen waste and/or food residues, significantly increases the process reliability.

The water content of the mass located in the funnel or in the product line is, in various embodiments, measured by means of a water content sensor, for example by means of an inductive measurement method, a microwave resonance method or a photometric method. Alternatively, however, other methods for determining the water content can also be used. On the basis of the results of measuring the water content, additional process water can correspondingly be fed in, generally until a predetermined water content is present, typically during the precomminution. Alternatively or additionally, the method sequence, the duration of the individual steps and/or the overall cycle time can be adjusted and/or adapted on the basis of the determined water content.

In order to prevent inorganic materials, such as textiles, plastics articles, such as films and/or gloves from passing into the grinding unit, according to several embodiments, during the precomminution, inorganic substances are separated, typically by the inorganic substances being caught and/or wound up on at least one rotating projection, for example a rotating precomminution blade, particularly an at least partially blunt-edged rotating precomminution blade, of the rotating precomminution unit. In addition, the possible pumped-away biomass used for the generation of biogas is thereby less interspersed with inorganic contaminants.

If, as provided in some embodiments of the method, ferromagnetic materials are sorted out from the kitchen waste and/or food residues, for example at least during the precomminution, by application of a magnetic force at least in a region of a funnel wall of the funnel, it can be prevented that said materials block the grinding unit and cause damage to the precomminution unit, the grinding unit and/or the pump. In addition, the possible pumped-away biomass used for generating biogas is thereby less interspersed with inorganic contaminations. The rotational movement of the precomminution unit gives rise to a flow, consequently the whirlpool, which, substantially on account of a centrifugal force, moves the relatively heavy ferromagnetic substances, such as cutlery parts, in the direction of the funnel wall, to which they are held and fixed by the magnetic force.

According to certain embodiments, the separated substances and/or the sorted out substances are removed from the funnel after the ending of the comminution and pumping-away operation. The entire funnel volume is thus available for refiling with kitchen waste and/or food residues to be comminuted.

According to several embodiments, in a final pumping-away phase, the funnel and/or a cover covering the funnel during operation is precleaned by means of injected process water. The process water is generally injected in the final homogenization phase when the input funnel is already substantially empty, wherein typically the process water is supplied via a nozzle directed onto the cover of the input station. This has the result that the process water is sprayed widely over the biomass still located in the funnel, and the cover and the funnel region are roughly cleaned.

According to some embodiments, the precomminution unit and/or the grinding unit rotate at a rotational speed of 700 to 2800 revolutions per minute, generally at a rotational speed of 1400 revolutions per minute, wherein the precomminution unit and the grinding unit typically rotate synchronously. The rotational speed can generally be set at a corresponding controller or predetermined by the latter. The higher the rotational speed of the rotating grinding unit and of the rotating precomminution unit, the smaller is the particle size arising during the comminution of the kitchen waste and/or food residues. The desired particle size of the comminuted kitchen waste and/or food residues can be set with the controller/regulator of the rotational speed. At a very small particle size, a suspension is formed in which solids and liquids are bound. The mass which is thus produced can then be particularly easily pumped, and on account of gravity, can already flow in a slightly inclined pipe in the direction of gravity, which permits virtually complete emptying of funnel, grinding unit and/or product line.

In order to obtain an improved comminution and/or mixing ratio or a higher degree of homogenization, the rotational speed of the precomminution unit and/or of the grinding unit can be varied, and/or the rotation of the precomminution unit and/or grinding unit can be interrupted and/or the direction of rotation of the precomminution unit and/or of the grinding unit can be reversed. The varying of the rotational speed, the interrupting of the rotation and/or the reversal of the rotational speed generally take place in accordance with a predetermined time sequence, wherein the sequence is typically controlled/regulated by means of controller.

In order to increase the efficiency of the method and to reduce the risk of injury to operating personnel, the method can be at least partially automated, wherein typically at least the beginning of the precomminution and/or the ending of the pumping-away operation take place automatically, wherein generally a sensor signal triggers the beginning of the precomminution and/or the beginning and/or the ending of the pumping-away operation.

It is generally determined by means of a sensor when the funnel is filled completely or up to a predetermined value. The filling level can be determined in a weight-based manner, inductively and/or visually. Alternatively, however, the filling level can also be measured by other types of sensors which are already known per se. If the filling of the funnel corresponds to the specified value and/or exceeds the latter, the sensor emits a corresponding signal which triggers beginning of the precomminution.

Furthermore, a rotational speed and/or torque and/or a rotational resistance of a drive driving at least the precomminution unit are at least partially or intermittently, generally continuously, determined typically during the precomminution. In a development, a time change of at least one of the determined values, generally the time change of the torque or of the rotational resistance, is compared with a predetermined limit value and/or specified value. The aforementioned time change can be used as a measure of the degree of homogenization of the kitchen waste and/or food residues, wherein, if the time change is smaller than the limit value and/or specified value and/or lies within a predetermined range, the mass produced by the precomminution is sufficiently homogeneous that effective pumping away by means of the pump and comminution taking place simultaneously in the grinding unit are possible. This can be used as a triggering signal for beginning of the pumping-away operation.

Furthermore, according to some embodiments, an empty state of the funnel and/or a liquid level in the product line can be detected, wherein, when the empty state is reached and/or a predetermined liquid level is fallen short of, an injection or re-injection of process water can be triggered, or the pumping-away operation can be ended. The empty state can be determined in a weight-based manner, inductively and/or visually.

The abovementioned object is furthermore achieved by a device for comminuting kitchen waste and/or food residues, for example for homogenizing kitchen waste and/or food residues.

Accordingly, a device is proposed for comminuting kitchen waste and/or food residues, for example for homogenizing kitchen waste and/or food residues. The device includes a funnel for receiving kitchen waste and/or food residues, a grinding unit, which is arranged at a base of the funnel, for comminuting, generally homogenizing, the kitchen waste and/or food residues, and a pump, which is connected via a product line to the grinding unit, for pumping away comminuted kitchen waste and/or food residues, wherein a precomminution unit, which extends from the funnel base into the interior of the funnel, for precomminuting the kitchen waste and/or food residues located in the funnel, is arranged in the funnel. A controller is provided which is configured to control precomminution by means of the precomminution unit and subsequently switching on of the pump for pumping away comminuted kitchen waste and/or food residues.

"Controller" is understood here as meaning a device which permits the directed influencing of the behaviour of technical systems both by specification of a specified value and by adaptation of the specified value as a result of a fed-back comparison signal or measurement signal or measurement element. The controller is consequently configured for controlling and/or regulating the device.

Owing to the fact that a controller is provided which is considered to control precomminution by means of the precomminution unit and subsequently switching on of the pump for pumping away comminuted kitchen waste and/or food residues, the advantages described with respect to the method can be analogously achieved.

In several embodiments, at least one funnel wall, generally all of the funnel walls, has/have an inclination of at least 45°, for example at least 50°, particularly at least 55° and generally at least 60° in relation to the horizontal. In other words, the funnel wall and the direction of gravitational acceleration enclose an angle of at maximum 45°, generally at maximum 40°, generally at maximum 35° and typically of at maximum 30°. The slope of the funnel wall makes it possible for the solids and liquids located in the funnel or for the suspension thereof to flow or move substantially automatically because of gravity in the direction of the funnel base. In order to be able to particularly reliably guarantee the automatic flow of the aforementioned materials, the funnel base has an inclination of at least 60° in relation to the horizontal.

The pump is generally connected via a transport line to a tank for receiving and/or storing the comminuted kitchen waste and/or food residues.

According to various embodiments, at least one sensor is provided for sensing a filling level in the funnel and/or in the product line, wherein the controller is configured to receive a sensor signal of the sensor. It is generally determined by means of the sensor if or whether the funnel and/or the product line is filled completely or up to a predetermined value. The filling level can be determined in a weight-based manner or visually. Alternatively, however, the filing level can also be determined by other types of sensors which are already known per se. If the filling of the funnel corresponds to the specified value and/or exceeds the latter, the sensor emits a corresponding signal to the controller, said signal generally triggering beginning of the precomminution by means of the controller.

According to certain embodiments, at least two sensors are provided, wherein a first sensor is provided for sensing an empty state of the funnel and a second sensor is provided for sensing a predetermined filling level, generally a beginning-of-operation filling level, wherein the controller is configured to receive sensor signals of the first and second sensor. In addition to the abovementioned determining of the filing level, an empty state of the funnel can thus furthermore be detected, wherein, when the empty state is reached, the controller can generally trigger an injection or reinjection of process water or end the pumping-away operation.

According to several embodiments, a further sensor is provided for sensing a liquid level in the product line, wherein the controller is configured to receive a sensor signal of the further sensor. In addition to the abovementioned determining of the filling level, a liquid level in the product line can thus furthermore be detected, wherein, when a predetermined liquid level is reached or fallen short of, an injection or reinjection of process water can be ended or triggered, or the pumping-away operation can be ended, via the controller.

According to some embodiments, the controller is configured to sense a torque and/or a rotational resistance of a drive driving the grinding unit and/or the precomminution unit, generally an electric motor, wherein the controller is typically furthermore configured to switch on the pump when a predetermined limit value of a time change of the torque and/or of the rotational resistance of the drive is fallen short of. Furthermore, generally during the precomminution, a rotational speed and/or a torque and/or a rotational resistance of a drive driving at least the precomminution unit are at least partially or intermittently, typically continuously, determined. In a development, a time change of at least one of the determined values, generally the time change of the torque or of the rotational resistance, is compared with a predetermined limit value and/or specified value. The aforementioned time change can be used as measure of the degree of the homogenization of the kitchen waste and/or food residues, wherein, if the time change is smaller than the limit value and/or specified value and/or lies within a predetermined range, the mass produced by the precomminution is sufficiently homogeneous that effective pumping away by the pump and comminution taking place simultaneously in the grinding unit are possible. This can be used as a triggering signal for beginning the pumping-away step. The controller is generally connected to at least one sensor for detecting the rotational speed, the torque and/or the rotational resistance.

At least one of the sensors is generally in the form of a sensor carrying out inductive measurements, in the form of a weight sensor or in the form of an optical sensor.

According to certain embodiments, a rotor of the grinding unit has, on its lower side at least one pump element, generally in the form of a web, for introducing a movement pulse to a mass, which is located below the grinding unit, in the direction of the pump. As a result, a pulse can be transmitted to the kitchen waste and food residues homogenized by means of the grinding unit, said pulse assisting conveying of the aforementioned mass in the direction of the pump.

BRIEF DESCRIPTION OF THE FIGURES

Further embodiments of the invention will be explained in more detail by the description below of the figures.

DETAILED DESCRIPTION

Exemplary embodiments will be described below with reference to the figures. Identical, similar or identically acting elements in the various figures are provided with identical reference signs, and a repeated description of said elements is partially dispensed with in order to avoid redundancy.

Figure 1:
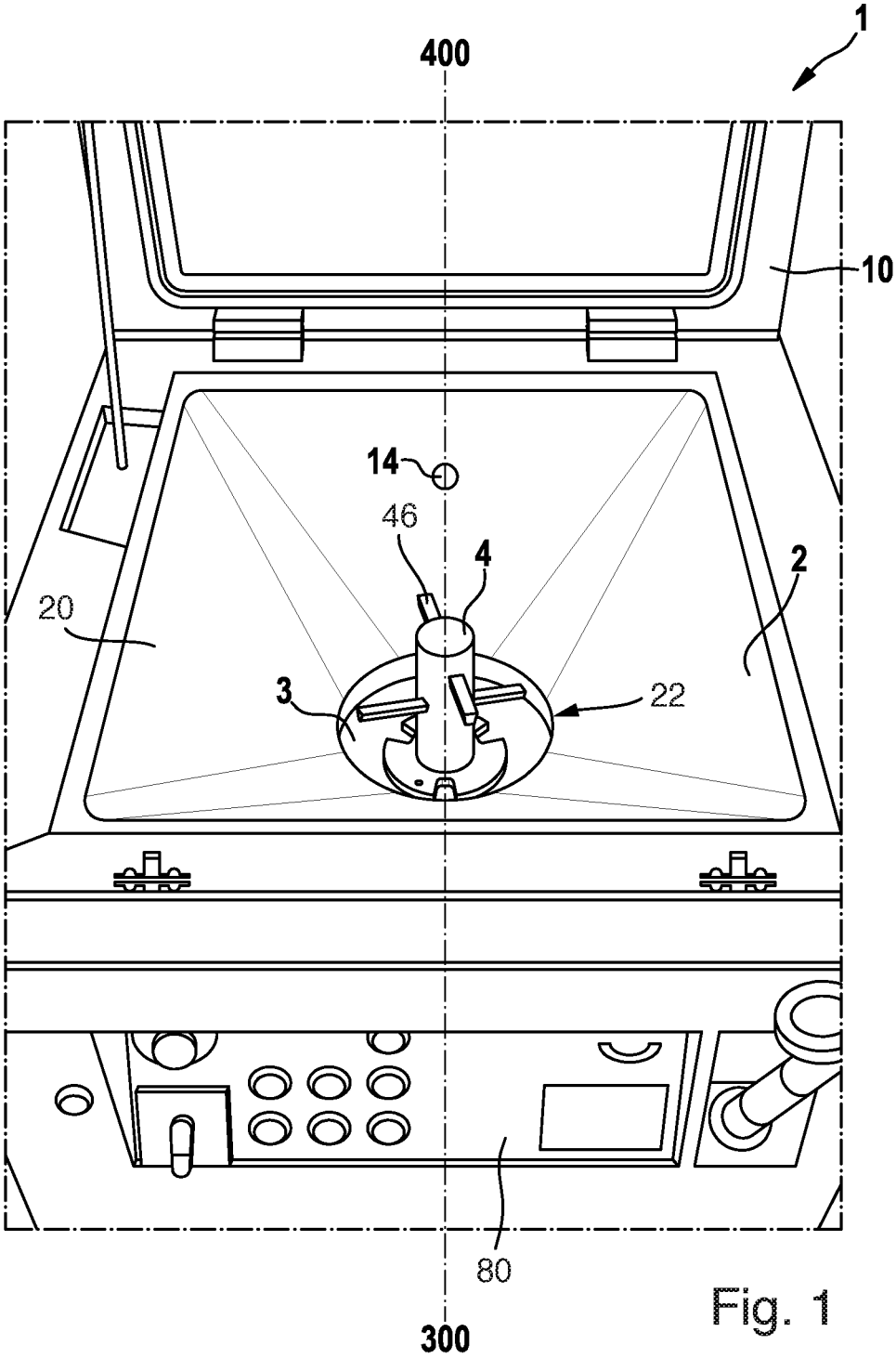
FIG. 1 schematically shows a perspective side view of a device for comminuting kitchen waste and/or food residues.

FIG. 1 shows, in a perspective schematic illustration, a device 1 which serves for comminuting kitchen waste and/or food residues. The device 1 includes a receiving device in the form of a funnel 2 which serves first of all for receiving the uncomminuted organic kitchen waste and food residues. The funnel 2 is shown in FIG. 1 in the form of a funnel 2 with a rectangular cross section. However, of course, other cross sections can also be used, for example square cross sections, round cross sections or oval cross sections. Furthermore, the funnel 2 can also have sections which are not funnel-shaped, for example cylindrical sections.

Figure 3:
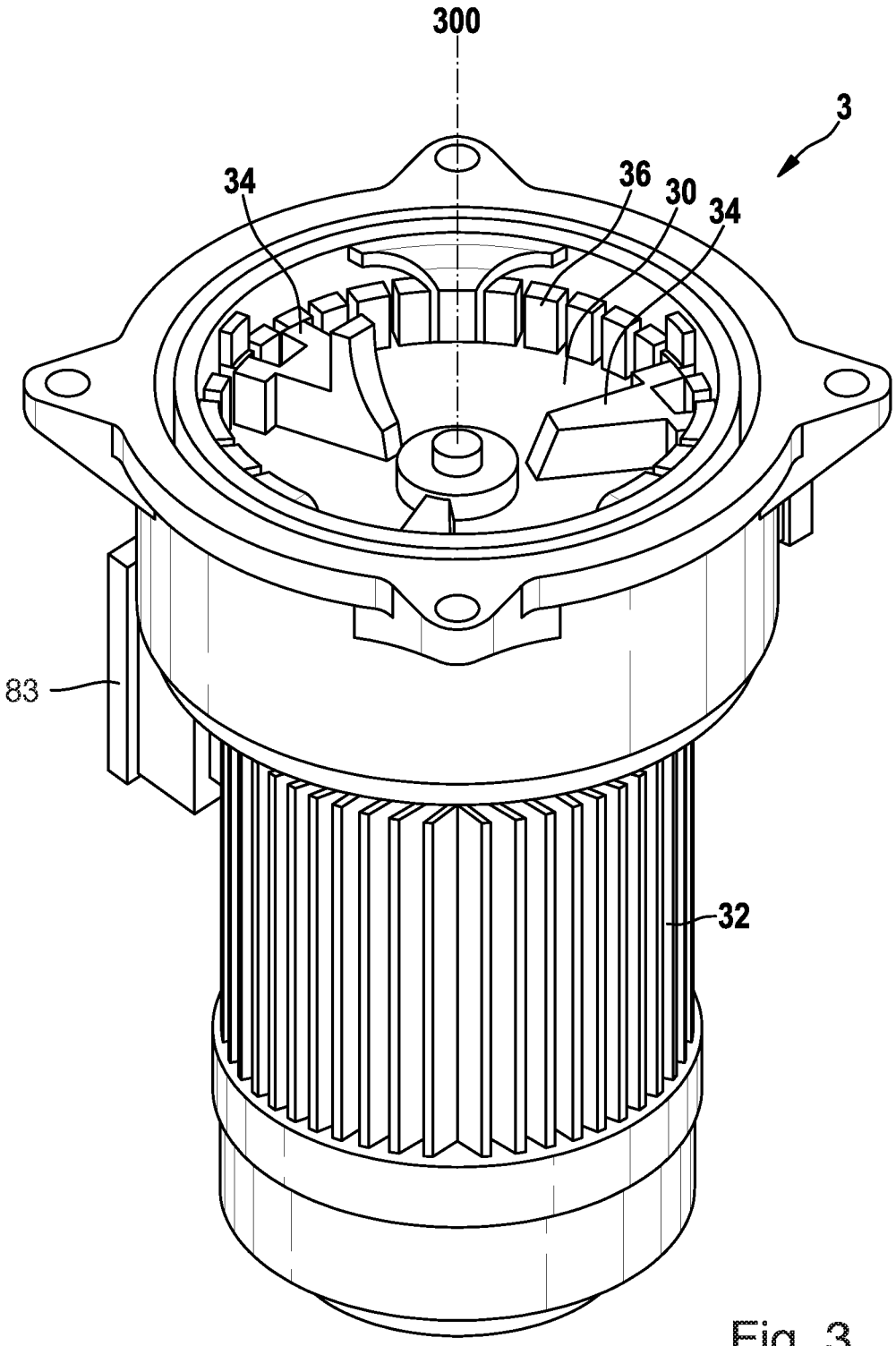
FIG. 3 schematically shows a perspective side view of a grinding unit of the device from FIG. 1.

A grinding unit 3 to which organic kitchen waste and food residues are supplied via the funnel 2 is provided at the lower end of the funnel 2. The grinding unit 3 serves for comminuting the organic kitchen waste and food residues supplied via the funnel 2. The grinding unit 3 can be provided, for example, in the form which is shown in FIG. 3 and is described further below.

A precomminution unit 4 is arranged on the grinding unit 3 and at least partially projects from the grinding unit 3 into the funnel 2. In other words, the precomminution unit 4 at least partially projects into the volume V defined by the dimensions of the funnel 2 (also see FIG. 2).

The precomminution unit 4 serves firstly for improved feeding of kitchen waste and food residues to the grinding unit 3. Feeding is understood here as meaning both the actual conveying of the organic kitchen waste and food residues, for example by means of a screw conveyor, and also the making of the organic kitchen waste conveyable by precomminution or mechanical shaking in order accordingly also to be able to feed light, loose, fibrous and/or dry kitchen waste and food residues, which have previously jammed in the funnel 2, to the grinding unit 3. The precomminution unit 4 therefore prepares the organic kitchen waste and/or moves same in such a manner that it is fed to the grinding unit 3 or slides into the latter. The precomminution unit 4 can be provided with precomminution blades 46 in order to precomminute the kitchen waste and food residues.

The device 1 furthermore includes a cover 10, by means of which the funnel 2 can be covered. The funnel 2 advantageously has to be covered with the cover 10 before the grinding unit 3 and the precomminution unit 4 are set into operation and begin to rotate. The cover 10 prevents the comminuted mass or mass which is to be comminuted from spraying out of the device 1 during operation. Furthermore, the cover 10 is present to avoid users reaching into the funnel 2 when the grinding unit 3 and/or the precomminution unit 4 is being operated. The cover 10 is advantageously connected to a controller which is not shown in this view and is equipped in such a manner that the grinding unit 3 and the precomminution unit 4 can be operated only when the cover 10 is closed.

The controller furthermore has an operator control unit 80 which is shown schematically and by means of which a user can make inputs to the controller and can receive information therefrom.

A nozzle 14 for feeding process water into the funnel 2 is provided on a funnel wall 20 of the funnel 2 in order, in the event of dry organic kitchen waste, to be able to provide a sufficient amount of water in order to permit subsequent pumping away of the biomass which has been comminuted by the grinding unit 3. For the pumping away of the moist and substantially homogenized biomass which has been comminuted by the grinding unit 3, a correspondingly dimensioned pump 5, which is shown for example in FIG. 2, is provided downstream of the grinding unit 3.

The nozzle 14 can furthermore also be used for cleaning the funnel 2 and the grinding unit 3, the precomminution unit 4 and/or the cover 10. However, for the cleaning or for the supply of process water, at least one further nozzle can also be provided at a different location in the funnel 2 and/or in a product line, described later on.

As emerges, for example, from FIG. 1, the precomminution unit 4 is arranged coaxially with respect to the grinding unit 3, wherein the axis of rotation 400 of the precomminution unit 4 extends coaxially along the axis of rotation 300 of the grinding unit 3 or the two axes of rotation 300, 400 coincide.

Figure 2:
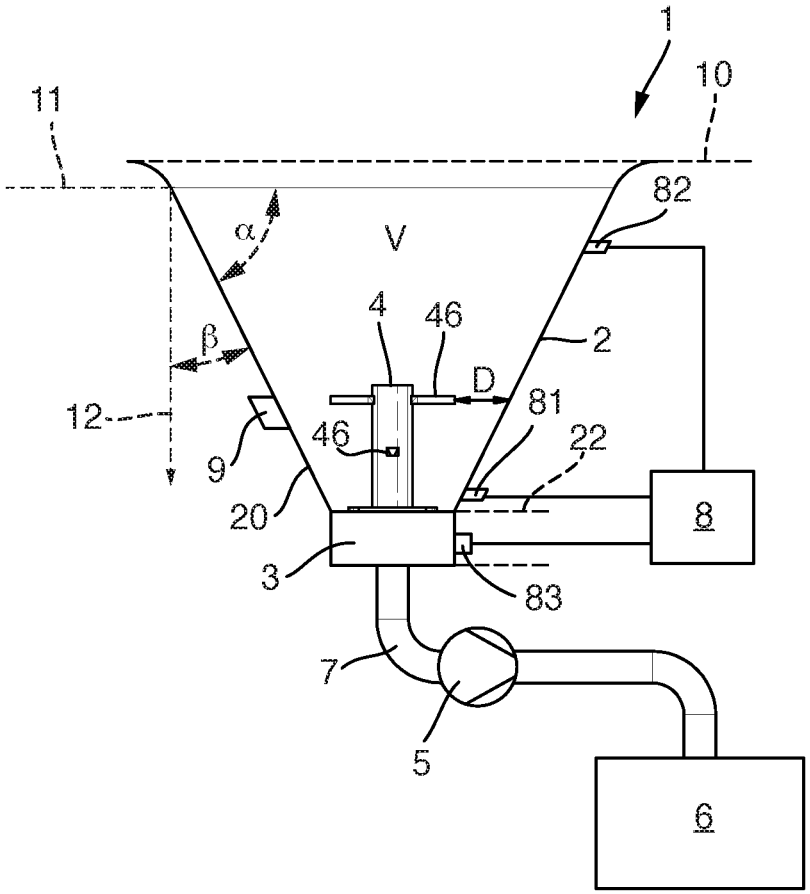
FIG. 2 schematically shows a sectional illustration of the device from FIG. 1.

FIG. 2 shows a schematic view of the device 1 in a schematic sectional illustration. It can clearly be seen in this figure that the precomminution unit 4 extends partially, if not completely, into the funnel 2 and extends in particular into the volume V formed in the interior of the funnel 2. The volume V is defined here by the volume located between the cover 10, the funnel base 22 and the funnel walls 20 of the funnel 2.

The depth by which the precomminution unit 4 extends into the funnel 2 is dependent inter alia on which organic kitchen waste and food residues are intended to be dealt with. Furthermore, the depth in this variant embodiment is dependent on the distance of the precomminution blades 46 of the driver 4 from the funnel wall of the funnel 2. Said distance D has to be dimensioned in such a manner that even relatively large light kitchen waste can still slip through between the rapidly rotating precomminution blades 46 and the wall of the funnel 2, and also in particular that a whirlpool, described in more detail further on, can be produced in the funnel 2.

The grinding unit 3 arranged at the funnel base 22 is connected via a product line 7 to a pump 5 for pumping away the comminuted biomass via a transport line 15 into a tank 6 for receiving the pumped-away biomass.

The product line 7 has a water inlet 16 through which process water can be introduced into the product line 7.

The lateral funnel walls 20 have an angle of inclination a of 60° in relation to the horizontal 13. In other words, the funnel wall and the direction of the gravitational acceleration 12 enclose an angle β of 30°. The high inclination or pitch of the funnel wall 20 makes it possible for the solids and liquids located in the funnel 1 or for the suspension thereof to flow or move substantially automatically due to gravity in the direction of the funnel base 22.

A magnet element 9, by means of which ferromagnetic materials can be sorted out of the kitchen waste and/or food residues by application of a magnetic force, is arranged on the funnel wall 20.

Furthermore, a first sensor 81 for detecting an empty state of the funnel 2 and a second sensor 82 for detecting a predetermined beginning-of-operation filling level in the funnel 2 are arranged on the funnel wall 20. The sensors 81, 82 are sensors which make visual measurements. Alternatively, the filling level can also be determined via a weight sensor or at least one acceleration sensor, wherein the filling level is determined in a weight-based manner. The controller 8 is configured to receive sensor signals of the first and second sensors 81, 82.

In addition, the controller 8 is configured to detect a rotational resistance of a drive driving the grinding unit 3 and the precomminution unit 4. For this purpose, a sensor 83 for detecting the rotational resistance is arranged on the grinding unit 3.

A pump 5 is connected to the output of the grinding unit 3 via a product line 7. The pump 5 is configured to pump away pumped-away, comminuted kitchen waste and food residues via the transport line 15 into a tank 6. The comminuted kitchen waste and food residues are generally conveyed for a certain distance in the transport line 15 by the pressure of the pump 5. Subsequently, the comminuted kitchen waste and food residues flow further into the tank 6 because of gravity.

FIG. 3 shows the grinding unit 3 in a schematic perspective view. The grinding unit 3 includes a rotor 30 which rotates about an axis of rotation 300 and is driven by a drive 32 in the form of an electric motor, to the motor shaft of which the rotor 30 is correspondingly connected. The drive 32 is advantageously provided with a powerful brake which immediately stops the drive 3 during operation thereof when the cover 10 is opened.

The rotor 30 includes differently shaped drivers 34 which can carry along the organic kitchen waste and food residues to be comminuted and can correspondingly set same into a rotational movement. A blade ring 36 is provided which surrounds the rotor 30 and which serves as a stator. The organic kitchen waste and food residues set into a rotational movement by the rotor 30 are correspondingly pressed by centrifugal forces against the blade ring 36 and guided along the latter in such a manner that comminution takes place in the corresponding gaps between the blades. The drivers 34 for their part brush along the blade ring 36, and therefore organic kitchen waste and food residues extending through the gaps located between the blades 36 can be sheared off by the driver 34. Other designs of the grinding unit 3 are likewise conceivable. The sensor 83 detects the rotational speed, the torque and the rotational resistance of the drive 32.

Figure 4:
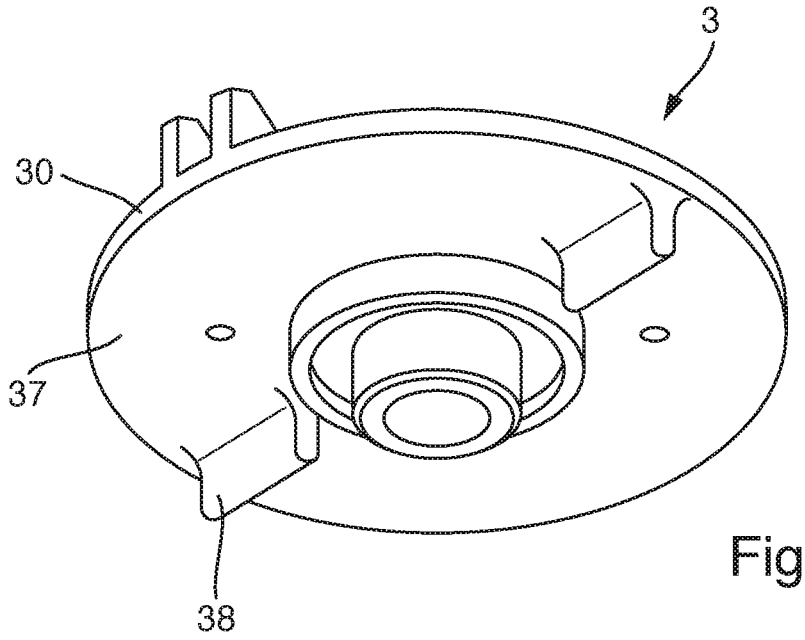
FIG. 4 schematically shows a perspective side view of a detail of a rotor of the grinding unit from FIG. 3.

A perspective side view of a detail of the rotor 30 of the grinding unit 3 can be schematically gathered from FIG. 4. The rotor 30 has, on its lower side 37, a plurality of pump elements in the form of webs 38 which extend downwards from the lower side 37 and are configured for introducing a movement pulse to a mass, which is located below the grinding unit 3, in the direction of the pump 5. As a result, a pulse which assists conveying of the aforementioned mass in the direction of the pump 5 can be transmitted to the kitchen waste and food residues which have been homogenized by the grinding unit 3.

A method for comminuting kitchen waste and/or food residues, for example for homogenizing kitchen waste and/or food residues, for example using the aforementioned device 1 is described below and shown in FIGS. 5 and 6, which show a whirlpool 13, described in detail below, in the funnel 2.

In a first step, kitchen waste and food residues which are to be comminuted are introduced into the funnel 2 and then the cover 10 is closed. After the cover 10 has been brought into the closed state, the controller 8 receives a corresponding signal and starts the processing cycle by means of the device 1.

First of all, a certain quantity of process water is introduced into the product line 7 via the water inlet 16 provided in the product line 7. If the third sensor 83 detects that the product line 7 has been filled with water up to a certain level, the controller 8 receives a corresponding signal and ends the introduction of the process water into the product line 7. In addition, the controller 8 starts the drive 32. As a result, the rotor 30 and the precomminution unit 4 fastened thereto are set into rotation. By means of the rotation of the precomminution unit 4, the latter begins to comminute or precomminute the kitchen waste and food residues located in the funnel 2, essentially by the precomminution blades 46 cutting up and breaking up the kitchen waste and food residues.

Since the pump 5 is in the switched-off state, the kitchen waste and food residues are not sucked off through the grinding unit 3, but rather remain in the funnel 2 and are further comminuted there. By means of the precomminution of the kitchen waste and food residues, the cell structures of the biowaste already in the funnel 2 are substantially smashed in such a manner that the water contained in the kitchen waste and food residues is already released in the funnel 2 and is made usable as a result before the kitchen waste and/or food residues are comminuted in the grinding unit 3.

An aqueous suspension with a mushy consistency is formed from the comminuted kitchen waste and food residues and the water beaten out therefrom in the funnel 2 because of the rotational movement of the precomminution unit 4. The kitchen waste and/or food residues precomminuted in this manner facilitate subsequent comminution by the grinding unit 3 when they are sucked off out of the funnel 2 through the grinding unit 3 because of starting of the pump 5. In order to increase the water portion of said suspension, process water can be added thereto via the nozzle 14.

On account of the rotation of the precomminution unit 4, in addition to the comminution effect, energy is also transmitted to the kitchen waste and food residues and sets same into rotation in the funnel 2. As a result, the precomminution unit 4 produces a circulating whirlpool 13 in the funnel 2. Consequently, the kitchen waste and/or food residues in the funnel additionally undergo stirring or mixing by the precomminution unit 4. The whirlpool 13 is thereby produced in the funnel 2 and allows the material in the funnel 2 to circulate in the horizontal and at the same time in the vertical direction. In the circulating whirlpool 13 produced by the precomminution unit 4, the kitchen waste and/or food residues rotate at different speeds depending on the position in the funnel 2. The speed of the kitchen waste and food residues is higher the closer they are to the precomminution unit 4. At increasing distance from the precomminution unit 4 and decreasing distance from the funnel wall 20, the speed decreases, wherein the particles are broken up in particular by rubbing against the funnel walls 20 and against one another. The parts or mass flows moving at different speeds and the rubbing of same against one another bring about a further comminution of the kitchen waste and food residues in the whirlpool 13, as a result of which the kitchen waste and food residues are already pre-homogenized to an even greater extent in the funnel 2. The precomminution consequently results in the formation of a relatively homogeneous biomass in the funnel 2, wherein the entire contents of the funnel 2 are gradually moved and comminuted by the whirlpool 13.

Figure 5:
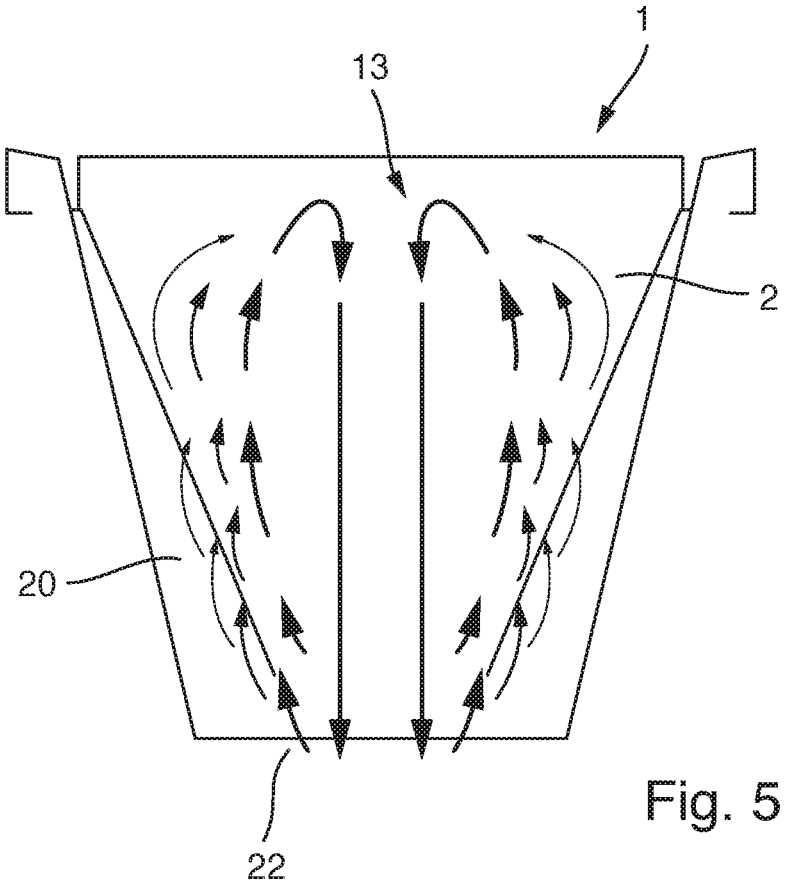
FIG. 5 schematically shows a sectional view of a funnel of the device from FIG. 1 with an indicated whirlpool.

FIG. 5 schematically shows a sectional view of the funnel 2. The whirlpool is indicated by means of the arrows numbered with the reference sign 13. The thickness of the arrows is a measure here of the speed. As can be gathered from FIG. 5, the materials located in the funnel 2 during the precomminution in the region of the centre of the funnel undergo a powerful acceleration in the direction of the funnel base 22 and are outwardly and upwardly deflected there, wherein they are substantially slowed down by rubbing against the funnel wall 20 and against one another. On arriving at the top, they are again grasped by the vacuum of the precomminution unit 4 (not shown here) and accelerated downwards again. The materials are at the same time comminuted further.

Figure 6:
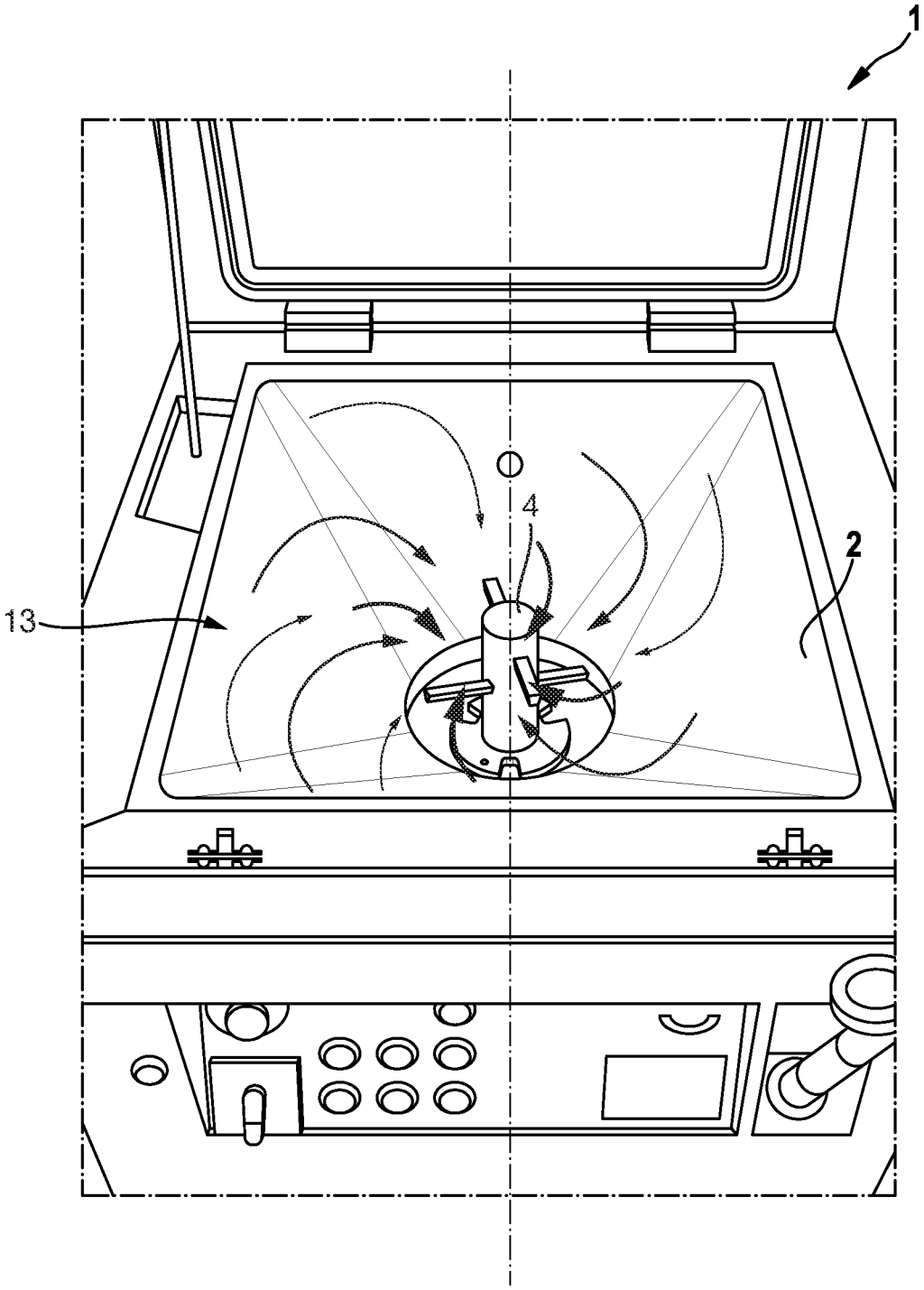
FIG. 6 schematically shows a perspective side view of the device from FIG. 1 with an indicated whirlpool.

FIG. 6 schematically shows a perspective side view of the device 1. The whirlpool is again indicated by means of the arrows numbered with the reference sign 13. The thickness of the arrows here is again a measure of the speed of the moving materials.

As can be gathered from FIGS. 5 and 6, the precomminution unit 4 forms a whirlpool 13 in the horizontal and at the same time in the vertical direction in the funnel 2.

Inorganic materials, such as textiles, plastics articles, such as films, or gloves are caught and wound up on the rotating precomminution blades 46 during the precomminution and are thereby separated from the organic components.

Furthermore, ferromagnetic materials, such as knives or forks, are sorted out from the whirlpool 13 by application of a magnetic force by means of the magnet element 9. The ferromagnetic materials remain adhering to the funnel wall 20 here in the region of the magnet element 9 because of the magnetic force.

In order to increase the water content of the suspension composed of the precomminuted kitchen waste and food residues, process water can additionally be added via the nozzle 14.

The precomminution takes place for the duration of a period of time selected at the operator control unit 80 before the pump 5 is started and therefore the pumping away of the precomminuted kitchen waste and food residues from the funnel 2 and therefore the comminution by the grinding unit 3 are started.

After a predetermined period of time of the pumping-away operation, the funnel 2 and the cover 10 are sprayed with injected process water by the nozzle 14. This has the result that the process water is sprayed widely over the biomass still located in the funnel, and the cover and the funnel region are roughly cleaned.

During the pumping-away operation, the liquid level in the product line is detected, wherein the pumping-away operation is ended when a predetermined liquid level is fallen short of.

A method for comminuting kitchen waste and/or food residues, for example for homogenizing kitchen waste and/or food residues, according to an alternative embodiment is described below. The method according to the alternative embodiment substantially corresponds to the previously described method, with the operating cycle having a higher degree of automation.

The precomminution is not already started here when the cover 10 is closed, but rather only if the second sensor 82 additionally recognizes that a predetermined filling level has been reached. The second sensor 82 then transmits a corresponding signal to the controller 8 which thereupon starts the precomminution 4.

The rotational speed of the precomminution unit 4 is varied during the precomminution between a rotational speed of 700 and 2800 revolutions per minute in order to obtain an improved mixing ratio and good comminution of different materials. In addition, the direction of rotation of the precomminution unit 4 is repeatedly changed during the precomminution.

Furthermore, the precomminution is not operated for a predetermined period of time, but rather begins when a change of the rotational resistance of the drive 32, which change is determined by the sensor 83 and the controller 8, lies within a predetermined rotational speed range below a certain limit value or limit amount. The aforementioned time change is used here as a measure of the degree of the homogenization of the kitchen waste and/or food residues, wherein, if the time change is smaller than the limit value, the mass produced by the precomminution is sufficiently homogeneous that effective pumping away by the pump and comminution taking place simultaneously in the grinding unit are possible.

The injection of the process water for preliminary cleaning is furthermore triggered by a signal of the first sensor 81 when the latter determines a predetermined empty state in the funnel 2. After the pumping-away operation is ended, process water is in addition conducted again through the nozzle 14 into the funnel 2 until the first sensor 81 detects that the water level is above the grinding unit 3. It is thereby prevented that residues of the comminuted kitchen waste and food residues dry on and encrust the grinding unit 3.

The present description also relates to a method for comminuting kitchen waste and/or food residues, for example for homogenizing kitchen waste and/or food residues, including the step of a funnel 2 for receiving kitchen waste and/or food residues, a base 22 of which is provided with a grinding unit 3 for comminuting, generally homogenizing, the kitchen waste and/or food residues and which is connected by the grinding unit 3 via a product line 7 to a pump 5 for pumping away comminuted kitchen waste and/or food residues, being loaded with kitchen waste and/or food residues to be comminuted, and the step of the kitchen waste and/or food residues, comminuted by the grinding unit 3 being pumped away by means of the pump 5, wherein ferromagnetic materials are sorted out from the kitchen waste and/or food residues, generally at least during the precomminution, by application of a magnetic force at least in a region of a funnel wall 20 of the funnel 2.

The device 1 correspondingly generally has a magnet device by means of which the magnetic force can be applied in at least one region of the funnel wall 20 of the funnel 2. The magnet device can be provided, for example, in the form of an electromagnet or a permanent magnet.

To the extent applicable, all individual features which are illustrated in the exemplary embodiments can be combined with one another and/or interchanged without departing from the scope of the invention.

The invention claimed is:

1. A device for comminuting kitchen waste or food residues, comprising:

a funnel configured to receive kitchen waste or food residues;

a grinding unit, arranged at a base of the funnel, configured to comminute the kitchen waste or food residues;

a precomminution unit, arranged in the funnel and extending from the base of the funnel into the interior of the funnel, configured to precomminute the kitchen waste or food residues in the funnel;

a pump, connected via a product line to the grinding unit, configured to pump away comminuted kitchen waste or food residues; and a controller configured to control the precomminution unit and to subsequently switch on the pump to pump away comminuted kitchen waste or food residues after precomminution of the kitchen waste or food residues.

2. The device of claim 1, further comprising at least one sensor configured to sense a filling level in the funnel or in a product line, and wherein the controller is further configured to receive a sensor signal of the at least one sensor.

3. The device of claim 1, further comprising at least two sensors, wherein a first sensor is configured to sense an empty state of the funnel and a second sensor is configured to sense a predetermined filling level, and wherein the controller is further configured to receive sensor signals of the first sensor and the second sensor.

4. The device of claim 3, further comprising a third sensor configured to sense a liquid level in a product line, and wherein the controller is further configured to receive a sensor signal of the third sensor.

5. The device of claim 1, further comprising a drive driving the grinding unit or the precomminution unit, and wherein the controller is further configured to switch on the pump when a predetermined limit value of a time change of a torque or a rotational resistance of the drive is not met.

6. The device of claim 1, wherein the grinding unit comprises a rotor and the rotor comprises at least one pump element disposed on a lower side of the rotor.

7. The device of claim 6, wherein the at least one pump element is in a form of a web configured to introduce a movement pulse to a mass.

8. A method for comminuting kitchen waste or food residues using the device of claim 1, comprising:

receiving the kitchen waste or food residues in the funnel;

precomminuting the kitchen waste or food residues in the funnel by the precomminution unit projecting into the funnel;

after the precommuniting, switching the pump on;

comminuting the precomminuted kitchen waste or food residues in the grinding unit disposed at the base of the funnel; and pumping away the comminuted kitchen waste or food residues by the pump connected to the grinding unit via the product line.

9. The method of claim 8, further comprising generating a whirlpool circulating in the funnel during the precomminuting.

10. The method of claim 8, further comprising introducing a predetermined quantity of process water into the funnel or the product line prior to or during the precomminuting.

11. The method of claim 8, further comprising separating inorganic substances during the precomminuting.

12. The method of claim 11, wherein separating the inorganic substances comprises catching and/or winding up the inorganic substances on at least one rotating precomminution blade of the precomminution unit.

13. The method of claim 8, further comprising sorting out ferromagnetic materials from the kitchen waste or food residues during the precomminuting.

14. The method of claim 13, wherein sorting out the ferromagnetic materials comprises applying a magnetic force to at least a region of a funnel wall of the funnel.

15. The method of claim 8, further comprising precleaning the funnel or a cover covering the funnel using injected process water during the pumping away.

16. The method of claim 8, wherein the precomminuting comprises rotating the precomminution unit at a rotational speed of 700 to 2800 revolutions per minute, or the comminuting comprises rotating the grinding unit at a rotational speed of 700 to 2800 revolutions per minute.

17. The method of claim 16, further comprising varying the rotational speed of the precomminution unit or the grinding unit, interrupting rotation of the precomminution unit or the grinding unit, or reversing a direction of rotation of the precomminution unit or the grinding unit.

18. The method of claim 8, wherein the precomminuting comprises rotating the precomminution unit at a rotational speed of about 1400 revolutions per minute, or the comminuting comprises rotating the grinding unit at a rotational speed of about 1400 revolutions per minute.

19. The method of claim 8, wherein the precomminuting comprises rotating the precomminution unit, the comminuting comprises rotating the grinding unit, and the precomminution unit and the grinding unit rotate synchronously.

20. The method of claim 8, wherein a sensor signal triggers a beginning of the precomminuting or an ending of the pumping away.

* * * * *